US010753660B2

(12) United States Patent
Fukui et al.

(10) Patent No.: US 10,753,660 B2
(45) Date of Patent: Aug. 25, 2020

(54) AIR-CONDITIONING APPARATUS

(71) Applicant: Mitsubishi Electric Corporation, Tokyo (JP)

(72) Inventors: Koji Fukui, Tokyo (JP); Masafumi Tomita, Tokyo (JP); Kazuki Okada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 4 days.

(21) Appl. No.: 15/524,024

(22) PCT Filed: Jan. 23, 2015

(86) PCT No.: PCT/JP2015/051919

§ 371 (c)(1),
(2) Date: May 3, 2017

(87) PCT Pub. No.: WO2016/117128

PCT Pub. Date: Jul. 28, 2016

(65) Prior Publication Data

US 2017/0336116 A1 Nov. 23, 2017

(51) Int. Cl.
*F25B 49/02* (2006.01)
*F25B 43/02* (2006.01)
(Continued)

(52) U.S. Cl.
CPC ..... *F25B 49/02* (2013.01); *F25B 1/00* (2013.01); *F25B 13/00* (2013.01); *F25B 31/004* (2013.01);
(Continued)

(58) Field of Classification Search
CPC ..... F25B 49/02; F25B 13/00; F25B 31/004; F25B 31/006; F25B 41/04; F25B 43/00;
(Continued)

(56) References Cited

U.S. PATENT DOCUMENTS

2002/0078698 A1 6/2002 Leisenheimer et al.
2011/0083456 A1* 4/2011 Wakamoto ..... F25B 41/00 62/115
2015/0033780 A1* 2/2015 Hatomura ..... F25B 13/00 62/208

FOREIGN PATENT DOCUMENTS

DE 100 62 948 A1 7/2002
DE 103 44 588 A1 5/2005
(Continued)

OTHER PUBLICATIONS

International Search Report of the International Searching Authority dated Apr. 21, 2015 for the corresponding International application No. PCT/JP2015/051919 (and English translation).
(Continued)

*Primary Examiner* — Tavia Sullens
(74) *Attorney, Agent, or Firm* — Posz Law Group, PLC

(57) ABSTRACT

An air-conditioning apparatus is able to ensure an appropriate flow rate of refrigerant and an appropriate amount of oil returned to a compressor that match operation conditions regardless of an operating state of a refrigerant circuit and a change in an operation condition. The air-conditioning apparatus includes: a first detector configured to detect a refrigerant temperature within an accumulator; a storage unit configured to store information regarding a two-layer separation temperature of refrigerant and refrigerating machine oil; a determiner configured to compare the refrigerant temperature with the two-layer separation temperature and determine a two-layer separation state of the refrigerant and the refrigerating machine oil; a second detector configured to detect a state of the refrigerant sucked by the compressor; and a control unit configured to adjust an opening degree of a flow control valve on the basis of the two-layer separation state and a state of the sucked refrigerant.

4 Claims, 2 Drawing Sheets

(51) Int. Cl.

| | |
|---|---|
| ***F25B 41/04*** | (2006.01) |
| ***F25B 13/00*** | (2006.01) |
| ***F25B 31/00*** | (2006.01) |
| ***F25B 43/00*** | (2006.01) |
| ***F25B 1/00*** | (2006.01) |

(52) U.S. Cl.

CPC ..... *F25B 41/04* (2013.01); *F25B 43/00* (2013.01); *F25B 43/02* (2013.01); *F25B 2400/16* (2013.01); *F25B 2400/23* (2013.01); *F25B 2500/28* (2013.01); *F25B 2600/2515* (2013.01); *F25B 2700/1931* (2013.01); *F25B 2700/1933* (2013.01); *F25B 2700/2104* (2013.01); *F25B 2700/2106* (2013.01); *F25B 2700/2108* (2013.01); *F25B 2700/2113* (2013.01); *F25B 2700/21151* (2013.01); *F25B 2700/21152* (2013.01); *F25B 2700/21163* (2013.01); *F25B 2700/21174* (2013.01)

(58) Field of Classification Search

CPC .. F25B 43/02; F25B 2400/16; F25B 2400/23; F25B 2500/28; F25B 2500/07; F25B 2500/08; F25B 2600/2515; F25B 2600/2501; F25B 2700/1931; F25B 2700/1933; F25B 2700/2104; F25B 2700/2106; F25B 2700/2108; F25B 2700/2113; F25B 2700/2115; F25B 2700/21152; F25B 2700/251163; F25B 2700/21174

See application file for complete search history.

(56) References Cited

FOREIGN PATENT DOCUMENTS

| | | | |
|---|---|---|---|
| JP | H07-189908 | A | 7/1995 |
| JP | 2003-262418 | A | 9/2003 |
| JP | 2006-078087 | A | 3/2006 |
| JP | 2011-163671 | A | 8/2011 |
| JP | 2012-082993 | A | 4/2012 |

OTHER PUBLICATIONS

Extended European Search Report dated Nov. 22, 2016 issued in corresponding EP patent application No. 15866389.8.

Office Action dated Oct. 17, 2017 corresponding to JP patent application No. 2016-570463 (and English machine translation attached).

Office Action dated Mar. 25, 2019 issued in corresponding CN patent application No. 201580073268.0 (and English translation).

Office Action dated Aug. 23, 2019 issued in corresponding CN patent application No. 201580073268.0 (and English translation).

Office Action dated Mar. 2, 2020 issued in corresponding CN patent application No. 201580073268.0 (and English translation).

* cited by examiner

AIR-CONDITIONING APPARATUS

CROSS REFERENCE TO RELATED APPLICATION

This application is a U.S. national stage application of PCT/JP2015/051919 filed on Jan. 23, 2015, the contents of which are incorporated herein by reference.

TECHNICAL FIELD

The present invention relates to an air-conditioning apparatus having a refrigerant circuit through which refrigerant circulates.

BACKGROUND ART

Conventionally, in a refrigeration cycle apparatus such as an air-conditioning apparatus, a refrigerant container for storing excess refrigerant is installed to prevent insufficiency in a refrigerant circuit due to a change in operation condition. One such refrigerant container is an accumulator installed at the suction side of a compressor and temporarily stores the refrigerant flowing out from an evaporator. Another such refrigeration container is a receiver disposed at a position through which the refrigerant in an intermediate pressure state flows and temporarily stores the refrigerant flowing out from a condenser or an evaporator.

Among the aforementioned refrigerant containers, the accumulator installed at the suction side of the compressor is required to have a function to store excess refrigerant. In addition, the accumulator is required to have a function to reduce a liquid back amount for preventing excessive liquid back the compressor and to assuredly return refrigerating machine oil flowing out from the compressor together with the refrigerant, to the compressor without storing the refrigerating machine oil in a large amount within the container. The amount of excess refrigerant varies depending on operation conditions such as an outdoor air condition and the operating frequency of the compressor. In general, under a low evaporating temperature condition, the amount of the circulating refrigerant tends to be small, and the amount of excess refrigerant tends to be large. On the other hand, under a high evaporating temperature condition, the amount of the circulating refrigerant tends to be large, and the amount of excess refrigerant tends to be small.

At a specific temperature or higher, the density of the refrigerating machine oil used together with the refrigerant in the air-conditioning apparatus becomes lower than the density of the refrigerant, so that two-layer separation of the liquid refrigerant and the refrigerating machine oil occurs. The temperature at which the two-layer separation occurs is referred to as separation temperature, and the two-layer separation temperature is different depending on a combination of refrigerant and refrigerating machine oil into two layers to be used. For example, whereas the two-layer separation temperature is equal to or lower than −50 degrees C. when ether oil (PVE) is used together with R410A refrigerant, the two-layer separation temperature increases to about −5 degrees C. when PVE is used together with R32 refrigerant.

In an air-conditioning apparatus including a refrigerant circuit having an accumulator, if refrigerating machine oil whose two-layer separation temperature is high is used, for example, if PVE is used together with R32 refrigerant, two-layer separation of the refrigerating machine oil and the liquid refrigerant occurs under a very low temperature condition (e.g., −20 degrees C.) under which the evaporating temperature of the refrigerant becomes low. As a result, the refrigerating machine oil separates in an upper layer above the liquid refrigerant within the accumulator and thus cannot return to a compressor via an oil return hole in a lower portion of the accumulator, so that seizure occurs at a sliding portion of the compressor. Thus, hitherto, a technique to reduce the amount of the liquid refrigerant flowing into the compressor and to be able to efficiently return a required amount of the oil to the compressor has been proposed (see, e.g., Patent Literature 1).

An existing air-conditioning apparatus includes an accumulator that includes: an airtight container; an inlet pipe and an outlet pipe that communicate within the airtight container; a perforated pipe that has one end connected to the outlet pipe at the outside of the airtight container and has a plurality of oil recovery holes formed along an up-down direction; and a first oil return pipe that has one end connected to the outlet pipe at the outer side of the airtight container and another end opened in a bottom portion of the airtight container. The air-conditioning apparatus is provided with a first opening/closing valve at any position in a connection portion between the first oil return pipe and the outlet pipe, is provided with a second opening/closing valve at any position in a connection portion between the outlet pipe and the perforated pipe at the outer side of the airtight container, and includes two-layer separation detection control means that controls the opening/closing valves by detecting a state of refrigerating machine oil and refrigerant stagnating within the airtight container, on the basis of at least one of the pressure or the temperature of the refrigerant.

CITATION LIST

Patent Literature

Patent Literature 1: Japanese Unexamined Patent Application Publication No. 2011-163671

SUMMARY OF INVENTION

Technical Problem

In the air-conditioning apparatus disclosed in Patent Literature 1, the first oil return pipe and the perforated pipe are connected to the outlet pipe at the outside of the airtight container, and the first opening/closing valve and the second opening/closing valve are provided between the airtight container and the respective connection portions to the outlet pipe, and opening and closing control of these opening/closing valves is performed by the two-layer separation detection control means. The air-conditioning apparatus performs returning of a required amount of the oil through such opening and closing control, even if two-layer separation occurs, while suppressing excessive flowing of the liquid refrigerant into the compressor.

In the existing air-conditioning apparatus, it is possible to control the amount of the liquid refrigerant flowing into the compressor and the amount of the oil returned to the compressor by opening/closing operation of the opening/closing valves. However, the existing air-conditioning apparatus does not include means that adjusts opening degrees of the values in accordance with an operating state of the refrigerant circuit or a change in an operation condition such as an external outdoor air condition. Thus, the air-conditioning apparatus does not accurately control the flow rate of the refrigerant and an appropriate amount of the returned oil that match the operation conditions, so that the performance and the reliability of the air-conditioning apparatus deteriorate.

The present invention has been made to overcome the above-described problem, and an object of the present invention is to obtain an air-conditioning apparatus that: is able to ensure an appropriate flow rate of refrigerant and an appropriate amount of oil returned to a compressor that match operation conditions regardless of an operating state of a refrigerant circuit and a change in an operation condition such as an outdoor air condition; and makes it possible to prevent deterioration of performance and deterioration of reliability.

Solution to Problem

An air-conditioning apparatus according to the present invention includes: a refrigerant circuit in which a compressor, a heat source side heat exchanger, a pressure reducing device, a use side heat exchanger, and a refrigerant container are sequentially connected via a pipe; a bypass pipe having one end positioned in the refrigerant container and another end connected to a pipe at a suction side of the compressor; a flow control valve provided on the bypass pipe; a first detector configured to detect a refrigerant temperature within the refrigerant container; a storage unit configured to store information regarding a two-layer separation temperature of refrigerant and refrigerating machine oil; a determiner configured to compare the refrigerant temperature with the two-layer separation temperature and determine a two-layer separation state of the refrigerant and the refrigerating machine oil; a second detector configured to detect a state of the refrigerant sucked by the compressor; and a control unit configured to adjust an opening degree of the flow control valve on the basis of the two-layer separation state and the state of the sucked refrigerant.

Advantageous Effects of Invention

According to the present invention, the air-conditioning apparatus includes: a determination unit configured to determine a two-layer separation state within the refrigerant container; and a controller configured to adjust the opening degree of the flow control valve on the basis of a result of the determination as to the two-layer separation state. Thus, bypass flow rate control is enabled through two-layer separation state determination with high accuracy, avoidance of unnecessary liquid back and assured oil return to the compressor are enabled, it is possible to avoid breakdown of the compressor caused due to liquid back, seizure of a sliding portion of the compressor, etc., and it is possible to achieve high reliability.

DESCRIPTION OF EMBODIMENTS

Figure 1:
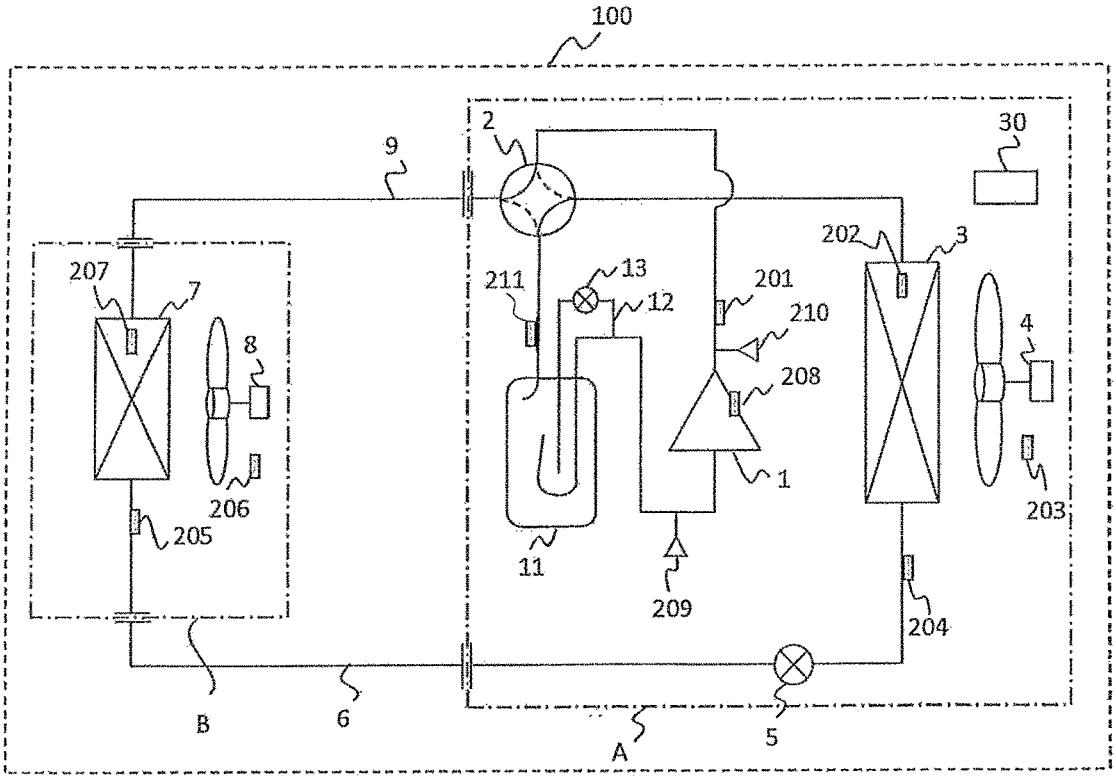
FIG. 1 is a configuration diagram of a refrigerant circuit schematically showing an air-conditioning apparatus according to Embodiment of the present invention.

Hereinafter, Embodiment of the air-conditioning apparatus of the present invention will be described with reference to the drawings. It should be noted that Embodiment of the drawings is an example and does not limit the present invention. In addition, in each drawing, components designated by the same reference signs are the same or equivalent components, and this is common throughout the specification. Furthermore, the relationship of the size of each constituent element in the drawings described below may be different from actual relationship.

Embodiment

[Apparatus Configuration]

FIG. 1 is a schematic diagram of configuration of a refrigerant circuit schematically showing an air-conditioning apparatus 100 according to Embodiment of the present invention. The air-conditioning apparatus 100 is an apparatus that is used for indoor cooling or heating by performing a steam compression type refrigeration cycle operation. As shown in FIG. 1, the air-conditioning apparatus 100 includes a heat source unit A and a plurality of utilization units B. In Embodiment, the case with a single utilization unit B will be described as an example. The heat source unit A and the plurality of utilization units B are connected to each other via a liquid connection pipe 6 and a gas connection pipe 9 that are refrigerant communication pipes.

Examples of refrigerant used in the air-conditioning apparatus 100 include HFC refrigerants such as R410A, R4070, R404A, and R32, HFO refrigerants such as R1234yf/ze, HCFC refrigerants such as R22 and R134a, and natural refrigerants such as carbon dioxide (CO2), hydrocarbon, helium, and propane.

[Utilization Side Unit B]

The utilization unit B is installed, for example, by being buried in an indoor ceiling, being hanged from the indoor ceiling, or being hanged on an indoor wall surface. The utilization unit B is connected to the heat source unit A via the liquid connection pipe 6 and the gas connection pipe 9 as described above, to form a part of a refrigerant circuit.

Next, the detailed configuration of the utilization unit B will be described. The utilization unit B forms an indoor side refrigerant circuit that is a part of the refrigerant circuit, and includes an indoor blower device 8 and an indoor heat exchanger 7. The indoor heat exchanger 7 corresponds to a "use side heat exchanger" in the present invention.

The indoor heat exchanger 7 is composed of, for example, a cross-fin type fin-and-tube heat exchanger including a heat-transfer tube and a large number of fins. The indoor heat exchanger 7 functions as an evaporator for the refrigerant to cool indoor air during cooling operation, and functions as a condenser for the refrigerant to heat the indoor air during heating operation.

The indoor blower device 8 is a fan capable of varying the flow rate of air supplied to the indoor heat exchanger 7, and is composed of, for example, a centrifugal fan driven by a DC motor (not shown), a multi-blade fan, or another fan. The indoor blower device 8 sucks the indoor air into the utilization unit B to exchange heat between the indoor air and the refrigerant within the indoor heat exchanger 7. Then, the indoor blower device 8 supplies the air subjected to the heat exchange, as supply air into an indoor space.

In addition, various sensors are provided in the utilization unit B. That is, a liquid side temperature sensor 205 for detecting the temperature of the refrigerant in a liquid state or two-phase gas-liquid state is provided at the liquid side of the indoor heat exchanger 7. The temperature of the refrigerant in the liquid state or the two-phase gas-liquid state includes a refrigerant temperature corresponding to a sub-cooled liquid temperature Tco during heating operation or an evaporating temperature Te during cooling operation.

In addition, a gas side temperature sensor 207 for detecting the temperature of the refrigerant in the two-phase gas-liquid state is provided at the indoor heat exchanger 7. The temperature of the refrigerant in the two-phase gas-liquid state includes a refrigerant temperature corresponding to a condensing temperature Tc during heating operation or the evaporating temperature Te during cooling operation.

Furthermore, an indoor temperature sensor 206 for detecting the temperature of indoor air flowing into the utilization unit B is provided at the indoor air suction inlet side of the utilization unit B. Each of the liquid side temperature sensor 205, the gas side temperature sensor 207, and the indoor temperature sensor 206 is composed of a thermistor. Operation of the indoor blower device 8 is controlled by a controller 30 (operation control unit).

[Heat Source Unit A]

Next, the detailed configuration of the heat source unit A will be described. The heat source unit A is installed outdoors, is connected to the utilization unit B via the liquid connection pipe 6 and the gas connection pipe 9, and forms a part of the refrigerant circuit.

The heat source unit A includes a compressor 1, a four-way valve 2, an outdoor heat exchanger 3, an outdoor blower device 4, a pressure reducing device 5, an accumulator 11, and a flow control valve 13. The outdoor heat exchanger 3 corresponds to a "heat source side heat exchanger" in the present invention. In addition, the accumulator 11 corresponds to a "refrigerant container" in the present invention.

The compressor 1 is a device capable of varying an operation capacity (frequency), and here, a displacement compressor that is driven by a motor (not shown) controlled by an inverter is used. Only the single compressor 1 is present here, but the present invention is not limited thereto, and two or more compressors 1 may be connected in parallel in accordance with the number of the connected utilization units B.

The four-way valve 2 is a valve having a function to switch the direction in which the refrigerant flows. The four-way valve 2 switches a refrigerant flow path such that, during cooling operation, the four-way valve 2 connects the discharge side of the compressor 1 to the gas side of the outdoor heat exchanger 3 and connects the suction side of the compressor 1 to the side of the gas connection pipe 9 (dotted lines in the four-way valve 2 in FIG. 1). With this configuration, during cooling operation, the outdoor heat exchanger 3 serves as a condenser for the refrigerant compressed by the compressor 1, and the indoor heat exchanger 7 serves as an evaporator for the refrigerant condensed by the outdoor heat exchanger 3.

Meanwhile, the four-way valve 2 switches the refrigerant flow path such that, during heating operation, the four-way valve 2 connects the discharge side of the compressor 1 to the side of the gas connection pipe 9 and connects the suction side of the compressor 1 to the gas side of the outdoor heat exchanger 3 (solid lines in the four-way valve 2 in FIG. 1). With this configuration, during heating operation, the indoor heat exchanger 7 serves as a condenser for the refrigerant compressed by the compressor 1, and the outdoor heat exchanger 3 serves as an evaporator for the refrigerant condensed by the indoor heat exchanger 7.

The outdoor heat exchanger 3 is composed of a cross-fin type fin-and-tube heat exchanger including a heat-transfer tube and a large number of fins. In the outdoor heat exchanger 3, a gas side pipe is connected to the four-way valve 2, and a liquid side pipe is connected to the liquid connection pipe 6, and the outdoor heat exchanger 3 serves as a condenser for the refrigerant during cooling operation, and serves as an evaporator for the refrigerant during heating operation.

The outdoor blower device 4 is a fan capable of varying the flow rate of air supplied to the outdoor heat exchanger 3, and is composed of, for example, a propeller fan driven by a DC motor (not shown). The outdoor blower device 4 has a function to suck outdoor air into the heat source unit A and discharge the air subjected to heat exchange with the refrigerant within the outdoor heat exchanger 3, to the outdoor space.

The pressure reducing device 5 is a device that is disposed so as to be connected to the liquid side of the heat source unit A and performs adjustment of the flow rate of the refrigerant flowing through the refrigerant circuit, etc.

The accumulator 11 is a refrigerant container that is disposed so as to be connected to a pipe at the suction side of the compressor 1. The accumulator 11 serves to store excess refrigerant during operation and to return refrigerating machine oil having flowed out from the compressor 1 together with the refrigerant, to the compressor 1 while suppressing excessive flowing of the liquid refrigerant into the compressor 1.

A bypass pipe 12 is a pipe having one end positioned in the accumulator 11 and another end bypassed to the pipe at the suction side of the compressor 1. The flow control valve 13 is provided on the flow path of the bypass pipe 12 and adjusts the flow rate of the refrigerant, etc. flowing through the bypass pipe 12.

Figure 2:
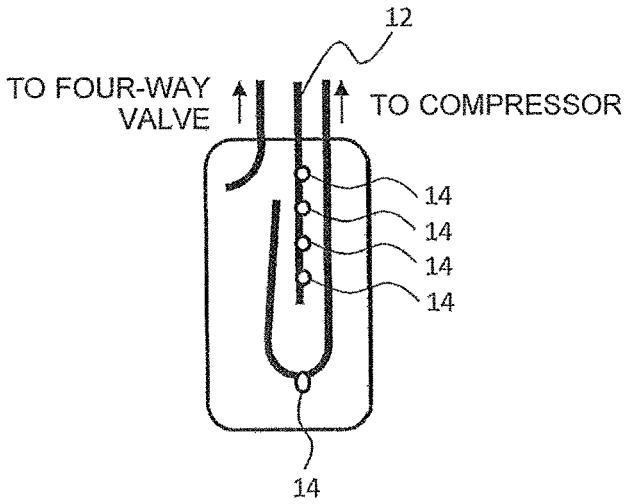
FIG. 2 is a schematic configuration diagram of the interior of an accumulator of the air-conditioning apparatus according to Embodiment of the present invention.

As shown in FIG. 1, the bypass pipe 12 at the inner side of the accumulator 11 does not have an oil return hole 14. However, as shown in FIG. 2, a plurality of oil return holes 14 may be provided in the bypass pipe 12 inside the accumulator 11 and along an up-down direction.

Various sensors are provided in the heat source unit A. A discharge temperature sensor 201 for detecting a discharge temperature Td of the refrigerant and a compressor shell temperature sensor 208 for detecting the shell temperature of the compressor are provided at the compressor 1. In addition, a compressor suction pressure sensor 209 is provided on the pipe at the suction side of the compressor 1, and a compressor discharge pressure sensor 210 is provided on a pipe at the discharge side of the compressor 1.

A gas side temperature sensor 202 for detecting the temperature of the refrigerant in the two-phase gas-liquid state is provided at the outdoor heat exchanger 3. The temperature of the refrigerant in the two-phase gas-liquid state includes a refrigerant temperature corresponding to the condensing temperature Tc during cooling operation or the evaporating temperature Te during heating operation. Furthermore, a liquid side temperature sensor 204 for detecting the temperature of the refrigerant in the liquid state or the two-phase gas-liquid state is provided on a pipe at the liquid side of the outdoor heat exchanger 3.

An outdoor temperature sensor 203 for detecting the temperature of the outdoor air flowing into the heat source unit A, that is, an outdoor air temperature Ta, is provided at the outdoor air suction inlet side of the heat source unit A. Here, each of the discharge temperature sensor 201, the gas side temperature sensor 202, the outdoor temperature sensor 203, the liquid side temperature sensor 204, and the compressor shell temperature sensor 208 is composed of a thermistor. Operations of the compressor 1, the four-way valve 2, the outdoor blower device 4, and the pressure reducing device 5 are controlled by the controller 30 (operation control unit).

As described above, the heat source unit A and the utilization unit B are connected to each other via the liquid connection pipe 6 and the gas connection pipe 9 to form the refrigerant circuit of the air-conditioning apparatus 100.

In Embodiment, the case with the single heat source unit A has been described as an example, but the present invention is not limited thereto, and two or more heat source units A may be provided. In addition, in the case where each of the heat source unit A and the utilization unit B is composed of a plurality of units, the capacities of the respective units may be different form each other, or may be all the same.

In Embodiment, the case where the four-way valve 2 is provided such that the refrigerant circuit capable of switching between heating operation and cooling operation is configured will be described, but the present invention is not limited thereto. For example, the four-way valve 2 may not be provided, and only cooling operation or only heating operation may be performed.

Figure 3:
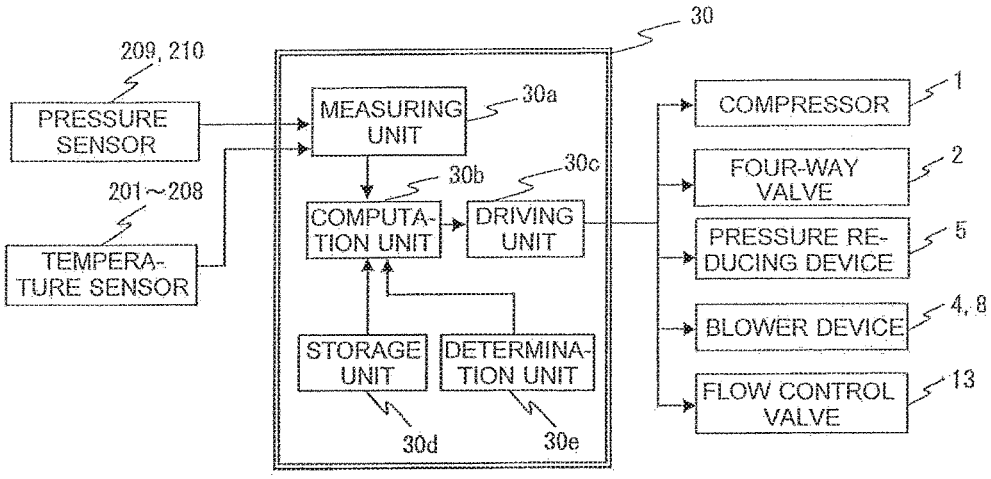
FIG. 3 is a control block diagram of the air-conditioning apparatus according to Embodiment of the present invention.

FIG. 3 is a control block diagram of the air-conditioning apparatus 100 according to Embodiment of the present invention. As shown in FIG. 3, the controller 30 performs measurement and control of the sensors and the actuators.

The controller 30 is incorporated in the air-conditioning apparatus 100, and includes a measuring unit 30*a*, a calculation unit 30*b*, a driving unit 30*c*, a storage unit 30*d*, and a determination unit 30*e*. The measuring unit 30*a*, the calculation unit 30*b*, the driving unit 30*c*, and the determination unit 30*e* are composed of, for example, a microcomputer. In addition, the storage unit 30*d* is composed of a semiconductor memory or the like.

Operation state amounts detected by various sensors (the pressure sensor and the temperature sensors) are inputted to the measuring unit 30*a*, and the measuring unit 30*a* performs measurement of pressure and temperature. The operation state amounts measured by the measuring unit 30*a* are inputted to the calculation unit 30*b*. The measuring unit 30*a* and the various sensors form a "first detector" in the present invention.

The calculation unit 30*b* calculates, for example, refrigerant physical property values (saturation pressure, saturation temperature, enthalpy, etc.) by using previously provided formulas or the like on the basis of the operation state amounts measured by the measuring unit 30*a*. The calculation unit 30*b* corresponds to a "second detector" in the present invention.

The driving unit 30*c* drives the compressor 1, the outdoor blower device 4, the pressure reducing device 5, and the flow control valve 13, etc. on the basis of the results of the calculation of the calculation unit 30*b*. The calculation unit 30*b* and the driving unit 30*c* form a "control unit" in the present invention.

The storage unit 30*d* stores the results obtained by the calculation unit 30*b*, predetermined constants, function expressions for calculating refrigerant physical property values (saturation pressure, saturation temperature, quality, etc.), and function tables (tables), etc. These contents stored in the storage unit 30*d* are able to be referred to or rewritten as necessary. A control program is further stored in the storage unit 30*d*, and the controller 30 controls the air-conditioning apparatus 100 in accordance with the program in the storage unit 30*d*.

The determination unit 30*e* performs magnitude comparison, and determination, etc. on the basis of the results obtained by the calculation unit 30*b*. The determination unit 30*e* corresponds to a "determiner" in the present invention.

In the configuration example of Embodiment, the controller 30 is incorporated in the air-conditioning apparatus 100, but the present invention is not limited thereto. A main controller may be provided in the heat source unit A, a sub controller having some of the functions of the controller 30 may be provided in the utilization unit B, and data communication may be performed between the main controller and the sub controller, thereby performing cooperative processing. Alternatively, the controller 30 having all the functions may be provided in the utilization unit B, or the controller 30 may be installed separately outside the air-conditioning apparatus 100.

[Basic Operation of Air-Conditioning Apparatus 100]

Subsequently, operation in each operation mode of the air-conditioning apparatus 100 according to Embodiment will be described. First, operation in cooling operation will be described with reference to FIG. 1.

During cooling operation, the four-way valve 2 is brought into a state shown by the dotted lines in FIG. 1, that is, a state where the discharge side of the compressor 1 is connected to the gas side of the outdoor heat exchanger 3 and the suction side of the compressor 1 is connected to the gas side of the indoor heat exchanger 7.

The high-temperature and high-pressure gas refrigerant discharged from the compressor 1 flows via the four-way valve 2 to the outdoor heat exchanger 3 that is a condenser, and the refrigerant condenses and liquifies by blowing operation of the outdoor blower device 4, to be high-pressure and low-temperature refrigerant. The condensed and liquified high-pressure and low-temperature refrigerant is reduced in pressure by the pressure reducing device 5 to be two-phase refrigerant, and is delivered via the liquid connection pipe 6 to the utilization unit B, and is delivered to the indoor heat exchanger 7. The two-phase refrigerant having been reduced in pressure evaporates at the indoor heat exchanger 7 that is an evaporator, by the blowing operation of the indoor blower device 8, to be low-pressure gas refrigerant. Then, the low-pressure gas refrigerant is sucked via the four-way valve 2 and the accumulator 11 into the compressor 1 again.

Here, the pressure reducing device 5 adjusts its opening degree to control the flow rate of the refrigerant flowing through the indoor heat exchanger 7, such that the degree of subcooling of the refrigerant at the outlet of the outdoor heat exchanger 3 is a predetermined value. Thus, the liquid refrigerant condensed by the outdoor heat exchanger 3 is brought into a state of having a predetermined degree of subcooling. The degree of subcooling of the refrigerant at the outlet of the outdoor heat exchanger 3 is detected as a value obtained by subtracting the detection value of the gas side temperature sensor 202 (corresponding to the condensing temperature Tc of the refrigerant) form the detection value of the liquid side temperature sensor 204. In this manner, the refrigerant having a flow rate corresponding to an operation load required in an air-conditioned space in which the utilization unit B is installed flows through the indoor heat exchanger 7.

Next, operation in heating operation will be described with reference to FIG. 1. During heating operation, the four-way valve 2 is brought into a state shown by the solid lines in FIG. 1, that is, a state where the discharge side of the compressor 1 is connected to the gas side of the indoor heat exchanger 7 and the suction side of the compressor 1 is connected to the gas side of the outdoor heat exchanger 3.

The high-temperature and high-pressure gas refrigerant discharged from the compressor 1 is delivered via the four-way valve 2 and the gas connection pipe 9 to the utilization unit B. Then, the high-temperature and high-pressure gas refrigerant reaches the indoor heat exchanger 7 that is a condenser, and the refrigerant condenses and liquifies by the blowing operation of the indoor blower device 8 to be high-pressure and low-temperature refrigerant. The condensed and liquified high-pressure and low-temperature refrigerant is delivered via the liquid connection pipe 6 to the heat source unit A, is reduced in pressure by the pressure reducing device 5 to be two-phase refrigerant, and is delivered to the outdoor heat exchanger 3. The two-phase refrigerant having been reduced in pressure evaporates at the outdoor heat exchanger 3 that serves as an evaporator, by the blowing operation of the outdoor blower device 4, to be low-pressure gas refrigerant. Then, the low-pressure gas refrigerant is sucked via the four-way valve 2 and the accumulator 11 into the compressor 1 again.

Here, the pressure reducing device 5 adjusts its opening degree to control the flow rate of the refrigerant flowing through the indoor heat exchanger 7, such that the degree of subcooling of the refrigerant at the outlet of the indoor heat exchanger 7 is a predetermined value. Thus, the liquid refrigerant condensed by the indoor heat exchanger 7 is brought into a state of having a predetermined degree of subcooling. The degree of subcooling of the refrigerant at the outlet of the indoor heat exchanger 7 is detected as a value obtained by subtracting the detection value of the gas side temperature sensor 207 (corresponding to the condensing temperature Tc of the refrigerant) form the detection value of the liquid side temperature sensor 205. In this manner, the refrigerant having a flow rate corresponding to an operation load required in an air-conditioned space in which the utilization unit B is installed flows through the indoor heat exchanger 7.

Here, the detection value of the temperature sensor installed at each heat exchanger is used as the condensing temperature Tc of the refrigerant. However, the discharge pressure of the refrigerant may be detected by the compressor discharge pressure sensor 210 at the compressor 1, a detection value of the discharge pressure may be converted on the basis of saturation temperature, and the resultant value may be used as the condensing temperature Tc of the refrigerant.

[Control Method for Flow Control Valve 13]

Figure 4:
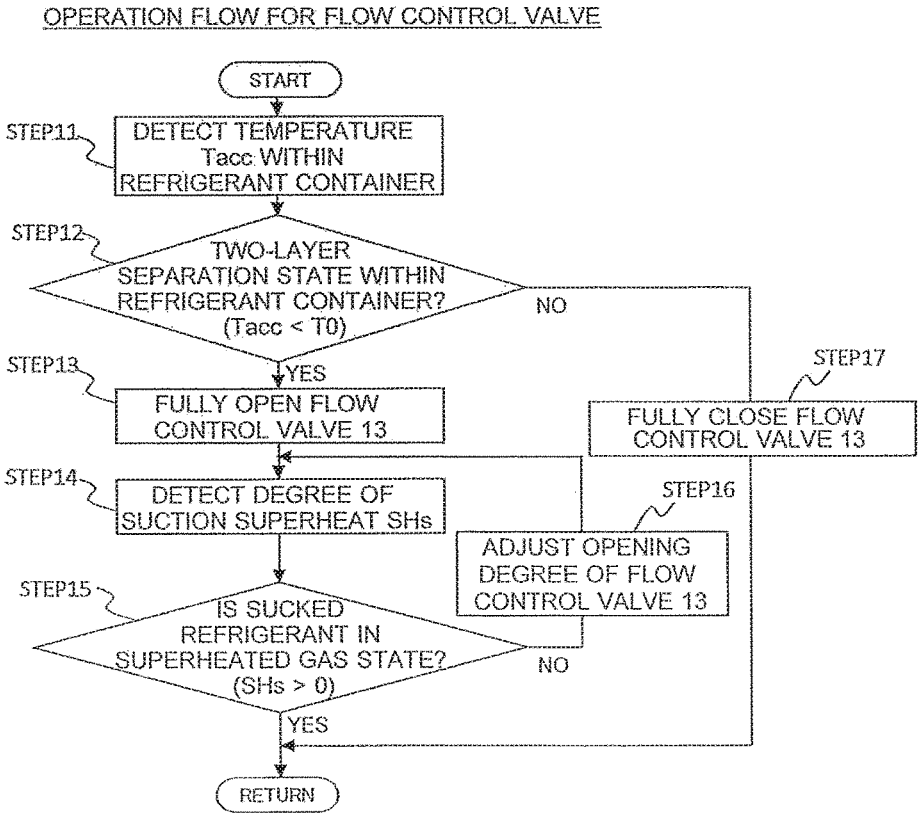
FIG. 4 is a flowchart showing flow of a control operation for a flow control valve of the air-conditioning apparatus according to Embodiment of the present invention.

FIG. 4 is a flowchart showing flow of a control operation for the flow control valve 13 of the air-conditioning apparatus 100 according to Embodiment of the present invention. Hereinafter, the control operation for the flow control valve 13 will be described on the basis of each step in FIG. 4 with reference to FIG. 1.

(Step 11)

After start of the flow, the measuring unit 30*a* detects a temperature Tacc within the refrigerant container. Thereafter, the flow shifts to (STEP 12). Here, for example, the temperature Tacc within the refrigerant container is the temperature of the refrigerant in the accumulator 11, and the evaporating temperature Te of the refrigerant is used. The detection value of the gas side temperature sensor 207 provided at the indoor heat exchanger 7 is used as the evaporating temperature Te of the refrigerant during cooling operation. In addition, the detection value of the gas side temperature sensor 202 provided at the outdoor heat exchanger 3 is used as the evaporating temperature Te of the refrigerant during heating operation.

Here, the detection value of the temperature sensor provided at each heat exchanger is used as the evaporating temperature of the refrigerant. However, suction pressure of the refrigerant may be detected by the compressor suction pressure sensor 209 provided at the suction side of the compressor 1, a detection value of the suction pressure may be converted on the basis of saturation temperature, and the resultant value may be used as the evaporating temperature of the refrigerant. In addition, a refrigerant temperature sensor 211 may be provided on a pipe at the inlet side of the accumulator 11, and a detection value of the refrigerant temperature sensor 211 may be used as the temperature Tacc within the refrigerant container.

(Step 12)

The determination unit 30*e* compares a two-layer separation temperature T0 of the refrigerating machine oil stored in the storage unit 30*d* in advance with the temperature Tacc within the refrigerant container, and determines whether two-layer separation of the liquid refrigerant and the refrigerating machine oil has occurred within the accumulator 11. If the temperature Tacc within the refrigerant container is lower than the two-layer separation temperature T0, the determination unit 30*e* determines that two-layer separation of the liquid refrigerant and the refrigerating machine oil has occurred, and the flow shifts to (STEP 13). On the other hand, if the temperature Tacc within the refrigerant container is higher than the two-layer separation temperature T0, the determination unit 30*e* determines that two-layer separation has not occurred, and the flow shifts to (STEP 17).

(Step 13)

The calculation unit 30*b* fully opens the flow control valve 13 via the driving unit 30*c*. Thereafter, the flow shifts to (STEP 14).

(Step 14)

The calculation unit 30*b* calculates the degree of superheat SHs of the refrigerant sucked by the compressor 1. Thereafter, the flow shifts to (STEP 15), Here, the degree of superheat SHs of the sucked refrigerant is a value obtained by subtracting the evaporating temperature Te of the refrigerant from the temperature Ts of the refrigerant sucked by the compressor 1, The detection value of the gas side temperature sensor 207 provided at the indoor heat exchanger 7 is used as the evaporating temperature Te of the refrigerant during cooling operation. In addition, the detection value of the gas side temperature sensor 202 provided at the outdoor heat exchanger 3 is used as the evaporating temperature Te of the refrigerant during heating operation.

For calculation of the temperature Ts of the sucked refrigerant, a low-pressure Ps (equivalent to the suction pressure of the compressor 1) obtained by converting the evaporating temperature Te of the refrigerant on the basis of saturation pressure, and a high-pressure pressure Pd (equivalent to the discharge pressure of the compressor 1) obtained by converting the condensing temperature Tc of the refrigerant on the basis of saturation pressure, are used. For calculation of the temperature Ts of the sucked refrigerant, a compression process of the compressor 1 is assumed as a polytropic change of a polytropic index n, and it is possible to obtain the temperature Ts of the sucked refrigerant by the following formula using the discharge temperature Td of the refrigerant detected by the discharge temperature sensor 201 at the compressor 1.

[Math. 1]

$$T_s = T_d \times \left(\frac{P_s}{P_d}\right)^{\frac{n-1}{n}} \quad \text{formula (1)}$$

Here, Ts and Ts are temperatures [K], Ps and Pd are pressures [MPa], and n is a polytropic index [–]. The polytropic index may be a fixed value (e.g., n=1.2). When the polytropic index is defined as a function of Ps and Pd, it is possible to accurately estimate the temperature Ts of the sucked refrigerant.

For calculating the high-pressure pressure (discharged refrigerant pressure) Pd and the low-pressure (sucked refrigerant pressure) Ps of the refrigerant, here, conversion with the condensing temperature Tc and the evaporating temperature Te of the refrigerant is performed. However, the high-pressure pressure (discharged refrigerant pressure) Pd and the low-pressure (sucked refrigerant pressure) Ps of the refrigerant may be obtained by using the detection value of the compressor suction pressure sensor 209 at the suction side of the compressor 1 and the compressor discharge pressure sensor 210 at the discharge side of the compressor 1. In addition, a temperature sensor may be provided at the suction side of the compressor 1 and may directly detect the sucked refrigerant temperature Ts.

(Step 15)

Whether the refrigerant sucked by the compressor 1 is in a superheated gas state is determined on the basis of the calculated degree of superheat SHs of the sucked refrigerant. If the refrigerant sucked by the compressor 1 is in a superheated gas state (SHs>0), the control flow is ended. If the refrigerant sucked by the compressor 1 is not in a superheated gas, the flow shifts to (STEP 16).

(Step 16)

The calculation unit 30*b* adjusts the opening degree of the flow control valve 13 via the driving unit 30*c* such that the opening degree is decreased. Thereafter, the flow shifts to (STEP 14). Here, for example, in the case where an electronic expansion valve is used as the flow control valve 13, the opening degree of the flow control valve 13 is adjusted according to the specifications of the valve and the opening degree characteristics by a method in which the opening degree is decreased in steps of a certain opening degree (e.g., 20 pulses). Here, the electronic expansion valve is taken as an example of the flow control valve 13, but a flow control valve 13 of another type may be used as long as it is capable of adjusting its opening degree similarly.

Here, the method for adjusting the opening degree of the flow control valve 13 on the basis of the degree of superheat SHs of the refrigerant sucked by the compressor 1 has been described, but the opening degree of the flow control valve 13 may be adjusted on the basis of a suction refrigerant quality instead of the degree of superheat SHs of the sucked refrigerant. In this case, with refrigerant quality X=1, the refrigerant is in a saturated gas state, and with refrigerant quality X>1, the refrigerant is in a superheated gas state. Thus, the opening degree of the flow control valve 13 may be adjusted such that the refrigerant quality≥1. The suction refrigerant quality may be stored as physical property information regarding the refrigerant in the storage unit 30*d* in advance, and may be obtained by using the temperature Ts of the refrigerant sucked by the compressor 1 or the low-pressure (sucked refrigerant pressure) Ps.

(Step 17)

The calculation unit 30*b* fully closes the flow control valve 13 via the driving unit 30*c*. Thereafter, the control flow is ended.

Because of the above, the calculation unit 30*b* adjusts the opening degree of the flow control valve 13 via the driving unit 30*c* on the basis of a two-layer separation state and the degree of superheat SHs of the sucked refrigerant, whereby bypass flow rate control is enabled through two-layer separation state determination with high accuracy. Accordingly, avoidance of unnecessary liquid back and assured oil return to the compressor 1 are enabled, it is possible to avoid breakdown of the compressor 1 caused due to liquid back or seizure of a sliding portion of the compressor 1, etc., and it is possible to achieve high reliability.

In addition, the calculation unit 30*b* adjusts the opening degree of the flow control valve 13, which is provided to the bypass pipe 12, via the driving unit 30*c* on the basis of the state of the sucked refrigerant at the suction side of the compressor 1. With this configuration, it is possible to constantly ensure an appropriate refrigerant flow rate and an appropriate amount of the oil returned to the compressor 1, regardless of the operating state of the refrigerant circuit and operation conditions such an outdoor air condition, and it is possible to prevent deterioration of performance and deterioration of reliability.

Furthermore, in the bypass pipe 12 connected from the interior of the accumulator 11 to the suction side of the compressor 1, a plurality of oil return holes 14 are provided at a pipe end inserted within the accumulator 11. Accordingly, even when an amount of liquid stored in the accumulator 11 changes due to a change in operation condition such as changes in outdoor air condition and operating frequency, it is possible to assuredly achieve oil return to the compressor 1.

[Modification of Cooling Apparatus]

Although the features of the present invention have been described in each Embodiment, the contents such as the refrigerant flow path configuration (pipe connection) and the configurations of the refrigerant circuit components such as the compressor 1, the heat exchangers, and the expansion valve are not limited to the contents described in each Embodiment and may be changed as appropriate within the technical scope of the present invention.

REFERENCE SIGNS LIST

1 compressor 2 four-way valve 3 outdoor heat exchanger 4 outdoor blower device 5 pressure reducing device 6 liquid connection pipe 7 indoor heat exchanger 8 indoor blower device 9 gas connection pipe 11 accumulator 12 bypass pipe 13 flow control valve 14 oil return hole 30 controller 30*a* measuring unit 30*b* calculation unit 30*c* driving unit 30*d* storage unit 30*e* determination unit 100 air-conditioning apparatus 201 discharge temperature sensor 202 gas side temperature sensor 203 outdoor temperature sensor 204 liquid side temperature sensor 205 liquid side temperature sensor 206 indoor temperature sensor 207 gas side temperature sensor 208 compressor shell temperature sensor 209 compressor suction pressure sensor 210 compressor discharge pressure sensor A heat source unit B utilization unit

The invention claimed is:

1. An air-conditioning apparatus comprising:

a refrigerant circuit in which a compressor, a heat source side heat exchanger, a pressure reducing device, a use side heat exchanger, and a refrigerant container are sequentially connected via refrigerant circuit pipes;

a bypass pipe having one end positioned in the refrigerant container and another end connected to a pipe of the refrigerant circuit pipes that is located at a suction inlet of the compressor;

a flow control valve provided on the bypass pipe;

a first sensor configured to detect the refrigerant mixture temperature of a refrigerant mixture of refrigerant and machine oil within the refrigerant container;

a controller that includes memory configured to store information regarding the two-layer separation temperature of refrigerant and refrigerating machine oil, wherein the controller is configured to:

determine the two-layer separation state of the refrigerant and the refrigerating machine oil by comparing the refrigerant mixture temperature within the refrigerant container to the two-layer separation temperature, adjust an opening degree of the flow control valve based on the determined two-layer separation state, determine the state of the refrigerant mixture suctioned into the compressor, and adjust the opening degree of the flow control valve based on the determined state of the suctioned refrigerant mixture, wherein the controller is configured to determine the state of the refrigerant mixture suctioned into the compressor by:

determining the degree of superheat of the suctioned refrigerant mixture; and the controller is configured to adjust the opening degree of the flow control valve on the basis of the determined two-layer separation state by:

setting the flow control valve to have a fully closed opening degree in response to a determination that the refrigerant and the refrigerating machine oil are not in the two-layer separation state, and setting the flow control valve to have a fully opened opening degree in response to a determination that the refrigerant and the refrigerating machine oil are in the two-layer separation state, wherein the controller is configured to adjust, after the flow control valve is set to have the fully opened opening degree in response to the determination that the refrigerant and the refrigerating machine oil are in the two-layer separation state, the opening degree of the flow control valve on the basis of the degree of superheat of the suctioned refrigerant mixture such that the refrigerant mixture suctioned into the compressor is constantly in a superheated gas state.

2. The air-conditioning apparatus of claim 1, wherein the bypass pipe has a plurality of oil return holes provided along an up-down direction and in a portion of the bypass pipe positioned in the refrigerant container.

3. An air-conditioning apparatus comprising:

a refrigerant circuit in which a compressor, a heat source side heat exchanger, a pressure reducing device, a use side heat exchanger, and a refrigerant container are sequentially connected via refrigerant circuit pipes;

a bypass pipe having one end positioned in the refrigerant container and another end connected to a pipe of the refrigerant circuit pipes that is located at a suction inlet of the compressor;

a flow control valve provided on the bypass pipe;

a first sensor configured to detect the refrigerant mixture temperature of a refrigerant mixture of refrigerant and machine oil within the refrigerant container;

a controller that includes memory configured to store information regarding the two-layer separation temperature of refrigerant and refrigerating machine oil, wherein the controller is configured to:

determine the two-layer separation state of the refrigerant and the refrigerating machine oil by comparing the refrigerant mixture temperature within the refrigerant container to the two-layer separation temperature, adjust an opening degree of the flow control valve based on the determined two-layer separation state, determine the state of the refrigerant mixture suctioned into the compressor, and adjust the opening degree of the flow control valve based on the determined state of the suctioned refrigerant mixture, wherein the controller is configured to determine the state of the refrigerant mixture suctioned into the compressor by:

determining the suction refrigerant quality of the suctioned refrigerant mixture; and the controller is configured to adjust the opening degree of the flow control valve on the basis of the determined two-layer separation state by:

setting the flow control valve to have a fully closed opening degree in response to a determination that the refrigerant and the refrigerating machine oil are not in the two-layer separation state, and setting the flow control valve to have a fully opened opening degree in response to a determination that the refrigerant and the refrigerating machine oil are in the two-layer separation state, wherein the controller is configured to adjust, after the flow control valve is set to have the fully opened opening degree in response to the determination that the refrigerant and the refrigerating machine oil are in the two-layer separation state, the opening degree of the flow control valve on the basis of the suction refrigerant quality of the suctioned refrigerant mixture such that the refrigerant mixture suctioned into the compressor is constantly in a superheated gas state.

4. The air-conditioning apparatus of claim 3, wherein the bypass pipe has a plurality of oil return holes provided along an up-down direction and in a portion of the bypass pipe positioned in the refrigerant container.

* * * * *